United States Patent [19]

Kuniyosi

[11] 3,948,476

[45] Apr. 6, 1976

[54] DETACHABLE MUSIC STAND FOR USE IN CONJUNCTION WITH A STRINGED INSTRUMENT

[76] Inventor: Shiniti Kuniyosi, 77-3-6 Minami Tumori-cho, Nisinari, Osaka, Japan

[22] Filed: Dec. 5, 1974

[21] Appl. No.: 518,803

[52] U.S. Cl. ..... 248/443; 248/447; 248/206 R

[51] Int. Cl.[2] ..... G10G 5/00

[58] Field of Search..... 248/206 R, 443, 441, 444, 248/447, 448, 454, 457, 463

[56] References Cited

UNITED STATES PATENTS

| | | | |
|---|---|---|---|
| 487,820 | 12/1892 | Benson | 248/443 |
| 857,504 | 6/1907 | Waldteufel | 248/443 |
| 1,086,179 | 2/1914 | Hunsaker | 248/443 |
| 2,527,899 | 10/1950 | Valasek | 248/206 R |
| 2,546,757 | 3/1951 | Krarup | 248/443 |
| 3,168,276 | 2/1965 | Schneider | 248/206 R |
| 3,194,406 | 7/1965 | Simeti et al. | 248/206 R |
| 3,496,297 | 2/1970 | Brumberger | 248/206 R |
| 3,541,322 | 11/1970 | Bennett | 248/206 R |
| 3,544,056 | 12/1970 | Berquist | 248/443 |

*Primary Examiner*—Roy D. Frazier
*Assistant Examiner*—Robert A. Hafer

[57] ABSTRACT

A detachable music stand adapted to be carried on a stringed instrument comprising a main body or music note support member on which a music note or book is adapted to held in position, an angle member having one arm connected to the underside of said main body, a first bar member having one end pivotally connected to the other arm of said angle member, first suction cups supported at a midpoint between the opposite ends of said first bar member, a second bar member pivoted at one end to the other end of said first bar member for pivotal movement relative thereto and second suction cups supported at the other end of said second bar member.

5 Claims, 3 Drawing Figures

DETACHABLE MUSIC STAND FOR USE IN CONJUNCTION WITH A STRINGED INSTRUMENT

BACKGROUND OF THE INVENTION

This invention relates to a music stand for a stringed instrument and more particularly, to a music stand particularly suitable to be detachably carried on a stringed instrument.

When a beginner practices on a stringed instrument, in most cases, he needs a music note. However, the conventional music stands for supporting music notes or books are adapted to be used in their erect position separate from the stringed instruments and in addition, the music stands generally have large sizes and can not be always erected suitably in any desired place. Furthermore, when the stringed instrument is played while the player is moving about and/or stands on a sloped floor, the conventional music stand can not be conveniently used.

Summary of the Invention

Therefore, one principal object of the present invention is to provide a novel and improved detachable music stand for use in conjunction with a stringed instrument which can effectively eliminate the disadvantages inherent in the conventional music stands referred to above.

Another object of the present invention is to provide a novel and improved detachable music stand for use in conjunction with a stringed instrument which is smaller in size as compared with the conventional music stands and can be used in any desired place whether the place is horizontal or sloped.

Another object of the present invention is to provide a novel and improved detachable music stand which can be conveniently carried on a stringed instrument when the instrument is played.

Another object of the present invention is to provide a novel and improved detachable music stand which can be easily and detachably carried on a stringed instrument which has attachment means by which the music stand can be attached to the main body or music note support member of the instrument.

Another object of the present invention is to provide a novel and improved detachable music stand for use in conjunction with a stringed instrument which has a main body or music note or book support member the position can be readily and conveniently adjusted relative to the stringed instrument.

According to the present invention, there has been provided a detachable music stand adapted to be carried on a stringed instrument which comprises in combination a music note support, an angle member having one arm which is normal to the plane of said music note support member and connected to the underside of said support member, a first bar member having one end pivoted to the other arm of said angle member extending in parallel to said support member, first attachment means mounted on said first bar member at a midpoint between the opposite end of the first bar member for attaching to a selected portion of said instrument, a second bar member having one end pivoted to the other end of said first bar member for pivotal movement between a first position in which the second bar member extends substantially in parallel to the first bar member and a second position in which the second bar member extends substantially at right angles thereto and second attachment means mounted at the other end of said second bar member for attaching to another selected portion of said instrument.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the invention in any way.

PREFERRED EMBODIMENT OF THE INVENTION

Figure 1:
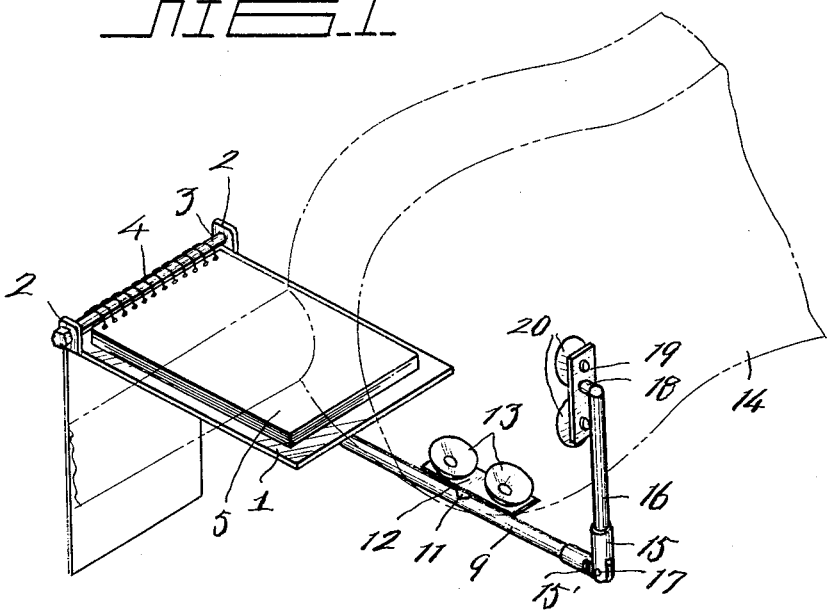
FIG. 1 is an isometric perspective view in front elevation of one embodiment of music stand constructed in accordance with the present invention showing the stand as being carried on a stringed instrument which is shown by phantasm lines.
Figure 2:
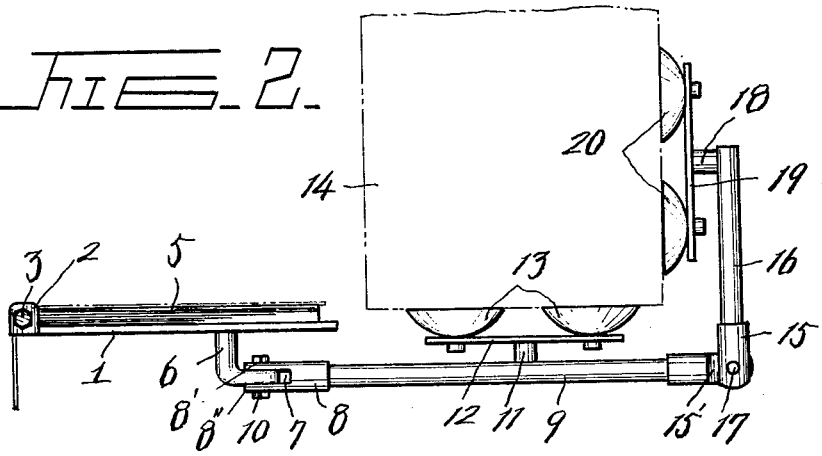
FIG. 2 is a side elevational view on an enlarged scale of said music stand of FIG. 1.
Figure 3:
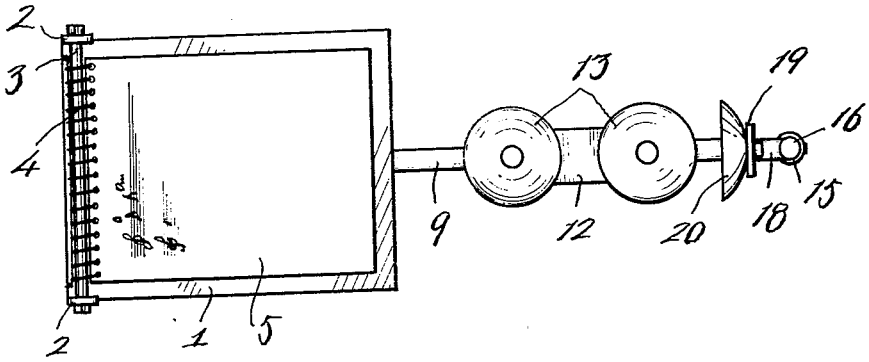
FIG. 3 is a top plan view of said music stand of FIG. 1 on an enlarged scale.

The present invention will be now described referring to the accompanying drawing which shows one preferred embodiment of music stand of the invention as being carried on a stringed instrument. The music stand generally comprises a main body or music note or book support member 1 in the form of a rectangular plate or board. The main body 1 has a pair of upright ears 2, 2 at one end extending uprightly on the opposite sides of the main body at the one end. The ears 2, 2 have holes through which a loose leaf-type binder means 3 extends and the binder means has a plurality of conventional binding loopes 4 thereabout so that a music book or a plurality of music notes 5 can be held on the main body 1 ready for being turned over in the conventional manner. An angle member 6 is connected at the upper end of one of the two arms of the angle member which is normal to the main body 1 to the underside of the latter in a suitable conventional manner and the other arm of the angle member extends at right angles to the first-mentioned arm and parallel to the music book or note supporting main body 1. The free end of the second arm of the angle member 6 is received in the opening 7 formed in a connecting member 8 which may be rigidly connected to or integral with one end of a first bar member 9 which is aligned with the other arm of the angle member 6. The upper and lower walls 8' and 8'' defining the opening 7 in the connecting member 8 are provided with aligned slots (now shown) through which a double-head pivot pin 10 extends. Thus, the position of the angle member 6 and accordingly, of the main body 1 can be adjusted relative to the first bar member 9. A pillar member 11 projects upwardly from the first bar member 9 at a substantially midpoint between the opposite ends of the bar and the pillar member supports at its upper end a suction cup support plate 12. A pair of suction cups 13 and 13 are secured at their bottoms to the suction cup support plate 12 and the open tops of the suction cups are adapted to be attached to a selected part of a stringed instrument 14 which is shown by phantasam lines in FIGS. 1 and 2 under vacuum force. The other end of the first bar member 9 is connected to a second or shorter bar member 16 by means of a swivel joint which includes a joint member 15 in the form of a flattened block connected to or integrally formed with the other end of the first bar member 9 and a second or bifurcated member 16 pivoted to the first joint member 15 extending normally at right angles thereto and embracing the first joint member 15. A double-head pivot pin 17 extends through the first and second joint members 15 and 16. The flattened first joint member 15 is formed on the opposite outer surfaces thereof with substantially circular recesses 15', 15' (only one of them is shown in FIG. 2) so that the second joint member 16 and accordingly, the second bar member 14 can be allowed to pivot with respect to the first joint member 15 about the pivot pin 17. A pillar member 18 extends laterally from the second bar 14 member at the other end thereof at right angles thereto and the free end of the pillar member supports a second suction cup support plate 19 to the inner surface of which the bottoms of a pair of second suction cups 20, 20 are rigidly secured to be attached to another selected portion of the stringed instrument 14 under suction force. The suction cups 13, 13 and 20, 20 are formed of rubber or the like material and have a maximum diameter within the range from 2.5 cm to 3.0 cm. Although the first pair of suction cups 13, 13 and second pair of suction cups 20, 20 are shown as being attached to the bottom adjacent to the front end and one side of the stringled instrument 14 under the action of vaccum force in FIGS. 1 and 2, respectively, the cups may be attached to other parts of the instrument as desired.

As mentioned hereinabove, when a beginner practices or plays on a stringed instrument, the player usually, needs a music note or book which is supported on a music stand. However, the conventional music stand is used in its erect position on a floor. However, the conventional music stand is generally large in size and can not be always suitably erected on any available or inclined floor. On the other hand, according to the present invention, since the novel music stand is always used as being carried on the associated stringed instrument when the instrument is played, the player can play or practice on the instrument as the player moves about on a horizontal or inclined floor or even as the player is seating on a chair. Furthermore, since the position of the music stand on the instrument can be readily adjusted relative to the instrument, the music notes or book supported on the music stand can be positioned in a suitable and convenient position for the player. In addition, since the music stand is attached to the stringed instrument by means of attachment means in the form of rubber cups which adhere to the instrument by suction or vacuum force, the tone quality of the stringed instrument with which the music stand is used will not be affected in any way by the attachment of the music stand to the instrument. Finally, by virture of the properties of the attachment means, the music stand can be easily attached to or detached from the instrument without requiring any specific tool.

While only one embodiment of the invention has been shown and described in detail, it will be understood that the same is for illustration purpose only and not to be taken as a definition of the invention, reference being had for the purpose to the appended claims.

What is claimed is:

1. A detachable music stand for use in conjunction with a stringed instrument which comprises in combination a music note support member, an angle member having one arm which is normal to the plane of said music note support member and connected to the underside of the support member, a first bar member having one end extending in parallel to said support member and pivoted to the other arm of said angle member which is parallel to said support member, first attachment means mounted on said first bar member at a midpoint between the opposite ends of the bar member for attaching to a selected portion of said instrument, a second bar member having one end pivoted to the other end of said first bar member for pivotal movement between a first position in which the second bar member extends substantially in parallel to the first bar member and a second position in which the second bar member extends substantially at right angles thereto and second attachment means mounted at the other end of said second bar member for attaching to another portion of said instrument.

2. The detachable music stand for use in conjunction with a stringed instrument as set forth in claim 1, in which the position of said music note support member is adjustable by said pivotal connection between said angle member and first bar member.

3. The detachable music stand for use in conjunction with a stringed instrument as set forth in claim 1, in which said first and second attachment means are in the form of rubber cups which adhere to said stringed instrument by suction.

4. The detachable music stand for use in conjunction with a stringed instrument as set forth in claim 1, in which said first attachment means are mounted at their bottoms on a support plate which is connected to a pillar member extending laterally from said first bar member at right angles thereto and the tops of said attachment means direct to said stringed instrument.

5. The detachable music stand for use in conjunction with a stringed instrument as set forth in claim 1, in which said second attachment means are mounted at their bottoms on a support plate which is connected to a pillar member extending laterally from said second bar member at right angles thereto and the tops of said second attachment means direct to said stringed instrument.

* * * * *